US005372188A

United States Patent [19]

Dudley et al.

[11] Patent Number: 5,372,188

[45] Date of Patent: * Dec. 13, 1994

[54] HEAT EXCHANGER FOR A REFRIGERANT SYSTEM

[75] Inventors: Jack C. Dudley; Leon A. Guntly, both of Racine; Michael J. Reinke, Franklin, all of Wis.

[73] Assignee: Modine Manufacturing Co., Racine, Wis.

[ * ] Notice: The portion of the term of this patent subsequent to Mar. 21, 2008 has been disclaimed.

[21] Appl. No.: 998,043

[22] Filed: Dec. 29, 1992

Related U.S. Application Data

[60] Continuation-in-part of Ser. No. 620,729, Dec. 3, 1990, which is a division of Ser. No. 141,628, Jan. 7, 1988, Pat. No. 4,998,580, which is a continuation-in-part of Ser. No. 902,697, Sep. 5, 1986, abandoned, which is a continuation-in-part of Ser. No. 783,087, Oct. 2, 1985, abandoned.

[51] Int. Cl.[5] ..... F28F 1/40; F28F 1/42; F25B 39/00

[52] U.S. Cl. ..... 165/110; 165/152; 165/153; 165/179; 165/183; 29/890.049; 29/890.07; 62/507; 62/515

[58] Field of Search ..... 165/179, 183, 110, 111, 165/152, 153, 150; 29/890.049, 890.07, 890.035; 62/507, 515

[56] References Cited

U.S. PATENT DOCUMENTS

| | | | |
|---|---|---|---|
| 2,136,641 | 11/1938 | Smith | 165/152 |
| 5,036,909 | 8/1991 | Whitehead et al. | 165/150 |

FOREIGN PATENT DOCUMENTS

| | | | |
|---|---|---|---|
| 52196 | 3/1984 | Japan | 165/183 |
| 63494 | 4/1984 | Japan | 165/183 |
| 1601954 | 11/1981 | United Kingdom | 165/183 |

*Primary Examiner*—Albert W. Davis, Jr.
*Attorney, Agent, or Firm*—Wood, Phillips, VanSanten, Hoffman & Ertel

[57] ABSTRACT

An improved heat exchanger for exchanging heat between the ambient and a refrigerant that may be in a liquid or vapor phase. The same includes a pair of spaced headers with one of the headers having a refrigerant inlet and the other of the headers having a refrigerant outlet. A heat exchanger tube extends between the headers and is in fluid communication with each of the headers. The tube defines a plurality of hydraulically parallel refrigerant flow paths between the headers and each of the refrigerant flow paths has a hydraulic diameter in the range of about 0.015 to about 0.07 inches.

16 Claims, 3 Drawing Sheets

FIG. 1
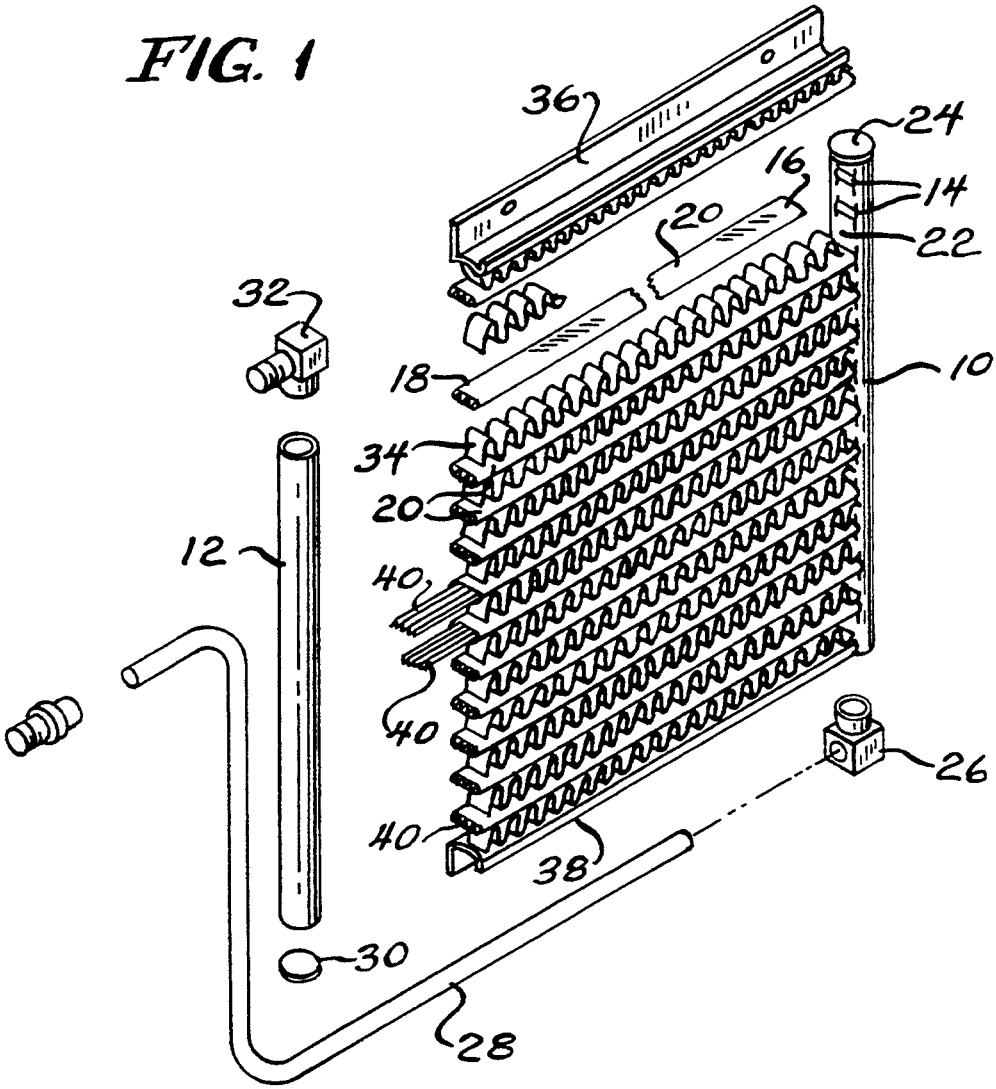
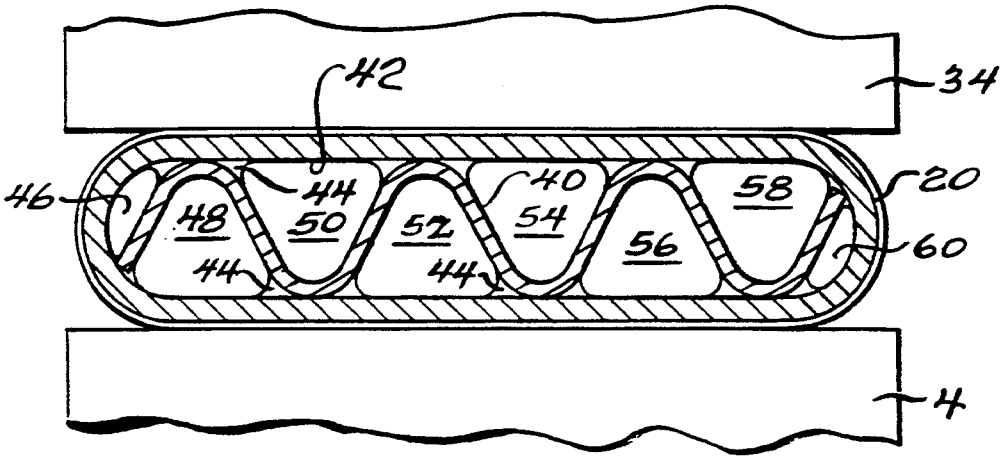
FIG. 2

HEAT EXCHANGER FOR A REFRIGERANT SYSTEM

CROSS REFERENCE

This application is a continuation in part of application Ser. No. 620,729 filed Dec. 3, 1990, which is a division of application Ser. No. 141,628 filed Jan. 7, 1988, now U.S. Pat. No. 4,998,580 and which, in turn, is a continuation in part of Ser. No. 902,697 filed Sep. 5, 1986, now abandoned, which is a continuation in part of Ser. No. 783,087, filed Oct. 2, 1985, now abandoned.

BACKGROUND OF THE INVENTION

In commonly assigned U.S. Pat. No. 4,688,311 issued Aug. 25, 1987 and U.S. Pat. No. 4,998,580 issued Mar. 12, 1991, the details of which are herein incorporated by reference, there are disclosed heat exchangers and methods of making the same which employ flattened tubes which, in turn, have a plurality of internal, hydraulically parallel flow paths of relatively small hydraulic diameter, i.e. a hydraulic diameter of about 0.07 inches or less. Hydraulic diameter is as conventionally defined, namely, the cross-sectional area of the flow path multiplied by four (4) and divided by the wetted perimeter of the flow path.

Exceptional improvements in heat transfer are achieved utilizing such tubes, particularly in air conditioning applications where heat is being transferred between the ambient and a refrigerant flowing through the tubes.

Moreover, the use of tubes having flow paths of relatively small diameter allows the manufacture of a heat exchanger with a reduced internal volume. When the heat exchanger is used in a refrigeration system, this feature minimizes the refrigerant charge required and thereby minimizes the potential amount of an environmentally hazardous refrigerant (e.g. chloroflourocarbons) that may leak to the environment in the event of a leak in the system.

Further, the efficiency of heat exchangers using such tubes is such that a heat exchanger having a heat exchange capacity equal to that of a prior art heat exchanger can be made and have only a fraction of the weight of the prior art heat exchanger. This is a particular advantage in automotive air conditioning systems because the weight reduction will ultimately show up as an improvement in fuel efficiency.

It is believed that the relatively small hydraulic diameters of the flow paths in such tubes advantageously take advantage of surface tension and capillary effects to achieve improvements in heat transfer as more fully explained in the above identified '580 patent.

In addition, where the tubes are fabricated by the method disclosed in the previously identified '311 patent, the interior refrigerant flow passages within the tubes will be provided with so-called microcracks as a consequence of residual brazing flux remaining from the NOCOLOK brazing process. This is also as more fully explained in the previously identified '580 patent and is believed to provide additional heat transfer efficiencies as well.

Still further, surface irregularities in the flow passages of tubes formed by extrusion methods are also believed to act just as the microcracks or surface irregularities caused by the flux residue to provide the same efficiencies in heat transfer.

The present invention seeks to provide a new and improved heat exchanger that makes use of one or more of the foregoing advantageous characteristics.

SUMMARY OF THE INVENTION

It is the principal object of the invention to provide a new and improved heat exchanger. More specifically, it is an object of the invention to provide a new and improved heat exchanger for exchanging heat between the ambient and refrigerant that may be in a liquid or vapor phase.

An exemplary embodiment of the invention achieves the foregoing object in a heat exchanger including a pair of spaced headers. One of the headers has a refrigerant inlet. One of the headers has a refrigerant outlet. The heat exchanger tube extends between the headers and is in fluid communication with each. The tube defines a plurality of hydraulically parallel refrigerant flow paths between the headers. Each of the refrigerant flow paths has a hydraulic diameter in the range of about 0.015 to 0.07 inches. Hydraulic diameter is defined as the cross-sectional area of each of the flow paths multiplied by four (4) and divided by the wetted perimeter of the corresponding flow path.

In one embodiment of the invention, the outlet is a condensate outlet and the heat exchanger is the condenser.

In another embodiment of the invention, the outlet is a vapor outlet and the heat exchanger is an evaporator.

In a preferred embodiment, the tube is in a serpentine configuration and in one embodiment, the tube is a single tube in a serpentine configuration.

The invention also contemplates that the inlet and the outlet be in different ones of the headers.

According to another embodiment of the invention, there are a plurality of tubes extending between the headers. The invention also contemplates that where there a plurality of tubes extending between the headers, each of the tubes is a serpentine tube.

Other objects and advantages will become apparent from the following specification taken in connection with the accompanying drawing.

DESCRIPTION OF THE DRAWINGS

FIG. 1 is an exploded, perspective view of a heat exchanger made according to the invention;

FIG. 2 is a fragmentary, enlarged, somewhat schematic cross-sectional view of a heat exchanger tube that may be employed in the invention and which may be made according to the method disclosed in the previously identified '311 patent;

DESCRIPTION OF THE PREFERRED EMBODIMENTS

Figure 3:
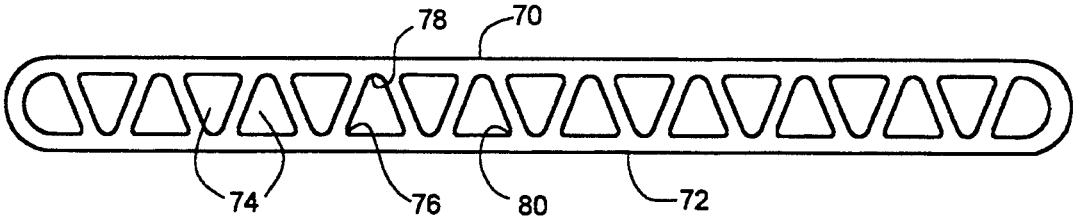
FIG. 3 is a view similar to FIG. 2 but showing a tube that is made by an extrusion process.

An exemplary embodiment of a heat exchanger made according to the invention is illustrated in FIG. 1 in the form of a condenser and is seen to include opposed, spaced, generally parallel headers 10 and 12. According to this embodiment of the invention, the headers 10 and 12 are preferably made-up from generally cylindrical tubing. On their facing sides they are provided with a series of generally parallel slots or openings 14 for receipt of corresponding ends 16 and 18 of refrigerant tubes 20. Preferably, between the slots 14 and the area shown at 22, each of the headers 10 and 12 is provided with a somewhat spherical dome to improve resistance to pressure as explained more fully in the commonly assigned Saperstein et al. U.S. Pat. No. 4,615,385, the details of which are herein incorporated by reference.

The header 10 has one end closed by a cap 24 brazed or welded thereto. Brazed or welded to the opposite end is a fitting 26 to which a tube 28 may be connected.

The lower end of the header 12 is closed by a welded or brazed cap 30 similar to the cap 24 while its upper end is provided with a welded or brazed-in-place fitting 32. Depending upon the orientation of the condenser, one of the fittings 26 and 32 serves as a vapor inlet while the other serves as a condensate outlet. For the orientation shown in FIG. 1, the fitting 26 will serve as a condensate outlet.

In some instances, the inlet and outlet may be in the same header in which case one or more baffles (not shown) will be employed to provide for multiple passes of the refrigerant across the space between the two headers.

A plurality of the tubes 20 extend between the headers 10 and 12 and are in fluid communication therewith. The tubes 20 are geometrically in parallel with each other and hydraulically in parallel as well. Disposed between adjacent ones of the tubes 20 are serpentine fins 34 although plate fins could be used if desired. Upper and lower channels 36 and 38 extend between and are bonded by any suitable means to the headers 10 and 12 as well as the fins 34 to provide rigidity to the system.

As can be seen in FIG. 1, each of the tubes 20 is a flattened tube and within its interior includes an undulating spacer 40. In cross section, the spacer 40 appears as shown in FIG. 2 and it will be seen that alternating crests are in contact with the interior wall 42 of the tube 20 and bonded thereto by fillets 44 of solder or braze metal. As a consequence, a plurality of hydraulically parallel fluid flow paths 46, 48, 50, 52, 54, 56, 58 and 60 are provided within each of the tubes. Typically, the crests will be bonded to the interior wall of all of the entirety of their lengths. This is accomplished by fabricating the tubes 20 with the spacers 40 according to the method in the previously identified '311 patent. In such a case, the components will be formed of aluminum and the brazing flux in the form of a potassium fluo aluminate complex will be employed. Those skilled in the art will recognize that the brazing process will be that known as the "NOCOLOK" brazing process.

According to the invention, each of the flow paths 48, 50, 52, 54, 56 and 58, and to the extent possible depending upon the shape of the insert 40, the flow paths 46 and 60 as well, have a hydraulic diameter in the range of about 0.015 to 0.07 inches. Hydraulic diameter is as conventionally defined, namely, the cross-sectional area of each of the flow paths multiplied by four and, in turn, divided by the wetted perimeter of the corresponding flow path.

Within that range it is desirable to make the tube dimension across the direction of air flow through the heat exchanger as small as possible. This, in turn, will provide more frontal area in which fins, such as the fins 34, may be disposed in the core of the heat exchanger without adversely increasing air side pressure drop to obtain a better rate of heat transfer. In some instances, by minimizing tubes widths, one or more additional rows of the tubes 20 can be included.

In this connection, the embodiment of FIG. 1 contemplates that tubes 20 with separate spacers 40 such as illustrated in FIG. 2 be employed as opposed to extruded tubes having passages of the requisite hydraulic diameter. However, as an alternative, extruded tubes such as shown in FIG. 3 may be used. The extruded tube has flat side walls 70 and 72 and contains a plurality of internal passages 74 having hydraulic diameter in the range of about 0.015 inches to about 0.07 inches. As can be seen in FIG. 3, the cross section of the passages 74 is nominally triangular and as a consequence, each passage has three elongated crevices 76, 78 and 80 that extend along its length. As pointed out more fully in the previously identified '580 patent, these crevices are believed to advantageously take advantage of surface tension and capillary effects to improve heat transfer.

An extruded tube such as shown in FIG. 3 also will have surface irregularities in the form of elongated striations extending along the length thereof. This is as a result of conventional extrusion manufacturing techniques and these striations are also believed to improve heat transfer in the same way as the surface irregularities denominated "micro cracks" in the previously identified '580 patent.

It is also desirable that the ratio of the outside tube periphery to the wetted periphery within the tube be made as small as possible so long as each of the flow paths does not become sufficiently small that the refrigerant cannot readily pass there through. This lessens resistance to heat transfer on the vapor and/or condensate side.

A number of advantages of a condenser as just described accrue. Inasmuch as they are described in detail in the previously identified '580 patent, in the interest of brevity, that description will not be repeated here.

Figure 4:
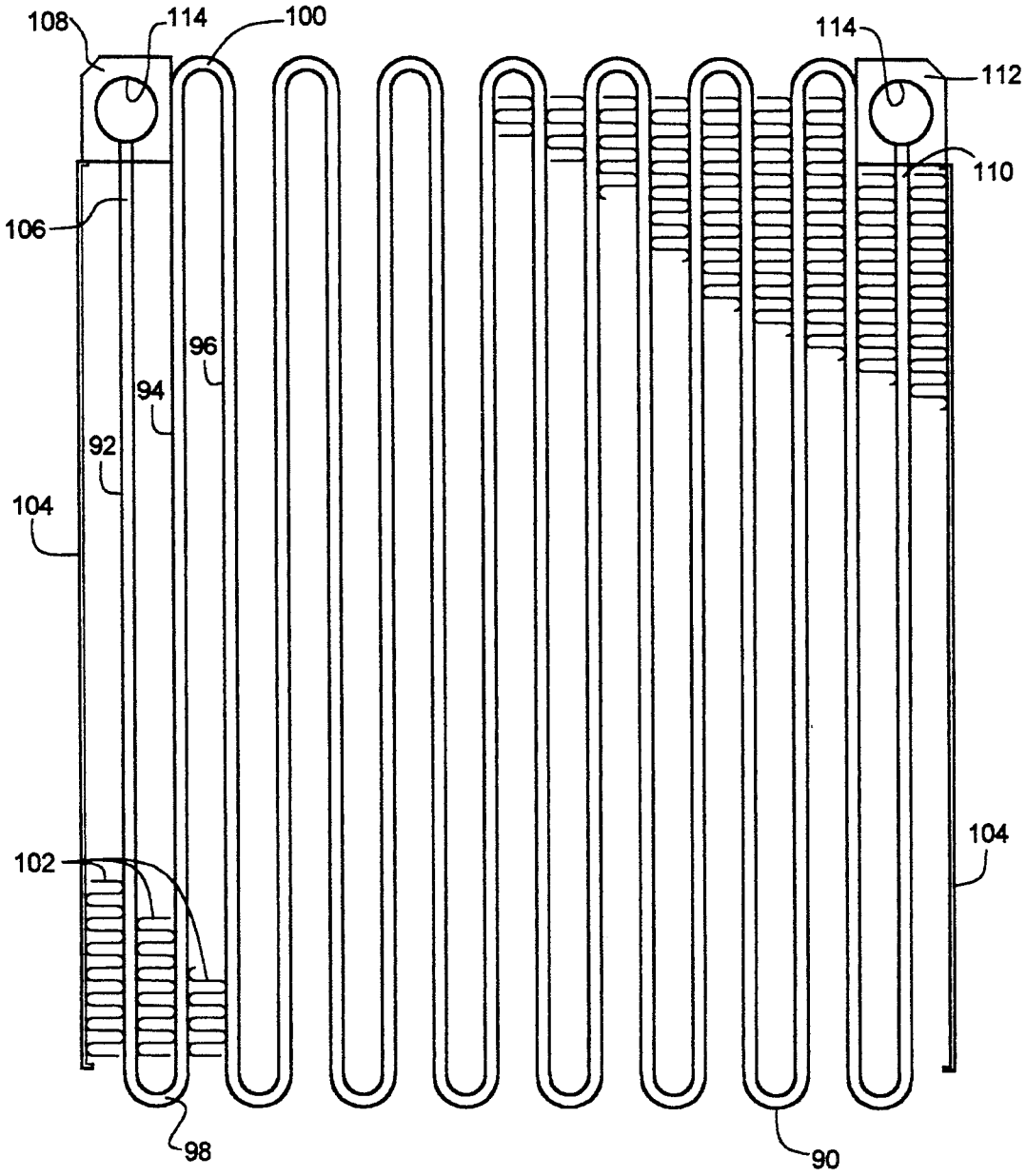
FIG. 4 is a front elevation of another embodiment of a heat exchanger made according to the invention.
Figure 5:
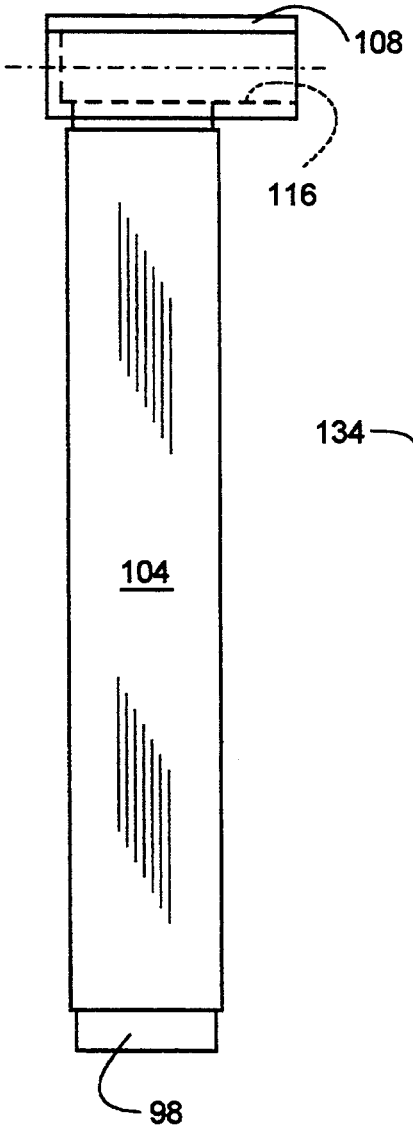
FIG. 5 is a side elevation of the embodiment shown in FIG. 4.
Figure 6:
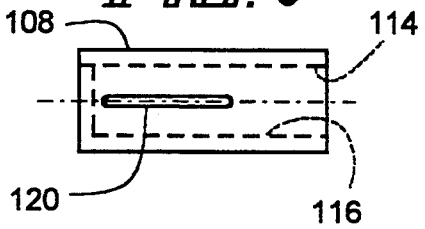
FIG. 6 is a view of a header employed in the embodiment of FIG. 4.

Turning now to FIGS. 4, 5 and 6, another embodiment of a heat exchanger for exchanging heat between a refrigerant and the ambient will be described. The embodiment illustrated in FIGS. 4, 5 and 6 may be used as a condenser or as an evaporator. The same includes an elongated tube 90 bent into a serpentine configuration. The tube 90 will typically be an extruded tube having the cross section illustrated in FIG. 3 but may be a fabricated tube having the cross section illustration in FIG. 2 if desired.

In the serpentine configuration, the tube 90 has a plurality of runs 92, 94, 96, etc. which are parallel to one another and joined to each other by bends such as shown at 98 and 100. Serpentine fins 102 are disposed between adjacent ones 92, 94, 96 as well as end pieces 104 at opposite side ends of the heat exchanger. Preferably, the fins 102 are louvered fins as is well known.

One end 106 of the tube 90 is in fluid communication with a header 108 while the opposite end 110 of the tube 90 is in fluid communication with a header 112. Both of the headers 108 and 112 include refrigerant ports 114 which may serve as an inlet or an outlet in connecting the heat exchanger into the system.

As seen in FIGS. 5 and 6, and referring to the header 108 as representative of both the headers 108 and 112, the same includes an interior bore 116 which terminates in the port 114. An elongated slot 120 having a configuration corresponding that to the outside shape of the tube 90 extends into the bore 116 from the exterior of the header 108. The tube end 106 is then received in the slot 120 and typically brazed therein to be sealed thereto.

In a preferred embodiment, the structure illustrated in FIG. 4 may occupy an area approximately six inches square and have the sixteen passes illustrated. The fins may have a fin pitch of twelve fins per inch and a fin height of approximately ¼". A louvered fin is employed as alluded to previously and the fin depth may be on the order of 5/6". It will be readily appreciated that the resulting heat exchanger is extremely compact and in spite of the small hydraulic diameters of the passages of the serpentine tube 90, unduly high pressure drops are not incurred because of the relatively small size of the structure. At the same time, because of the use of tubes having relatively small hydraulic diameters, the tube minor dimension is relatively small and allows the same to be bent at the loops 98 on a relatively tight radius which, in turn, permits the use of louvered fins with short fin heights. This, in turn, increases air side surface area to further enhance heat transfer.

Figure 7:
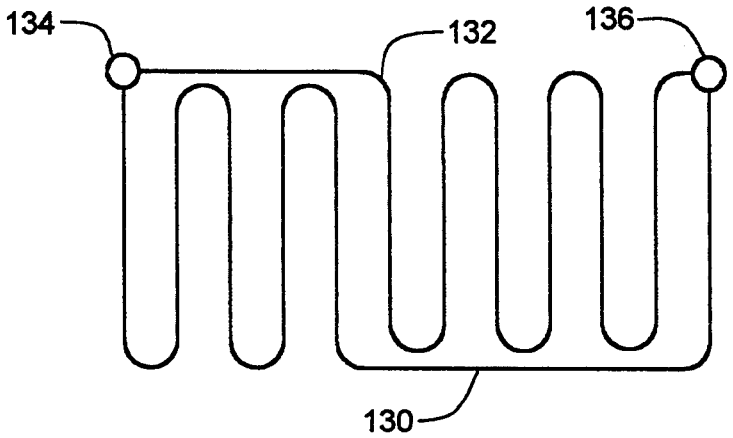
FIG. 7 is a schematic of one configuration of a multiple tube form of the embodiment illustrated in FIG. 4.

In some instances, because of the small hydraulic diameter of the flow passages in the tubes, it may be necessary to employ plural tubes extending between the header to overcome refrigerant side pressure drop constraints. In such a case, a plurality of tubes may extend between headers. FIG. 7 schematically illustrates one such configuration where a tube 130 and another tube 132 extend between a pair of headers 134 and 136 and also are in a serpentine configuration over the vast majority of their length. In the embodiment illustrated in FIG. 7, each of the tubes 130 and 132 provides six passes. This embodiment contemplates that all of the passes of all of the tubes 130 and 132 be in a single plane.

Figure 8:
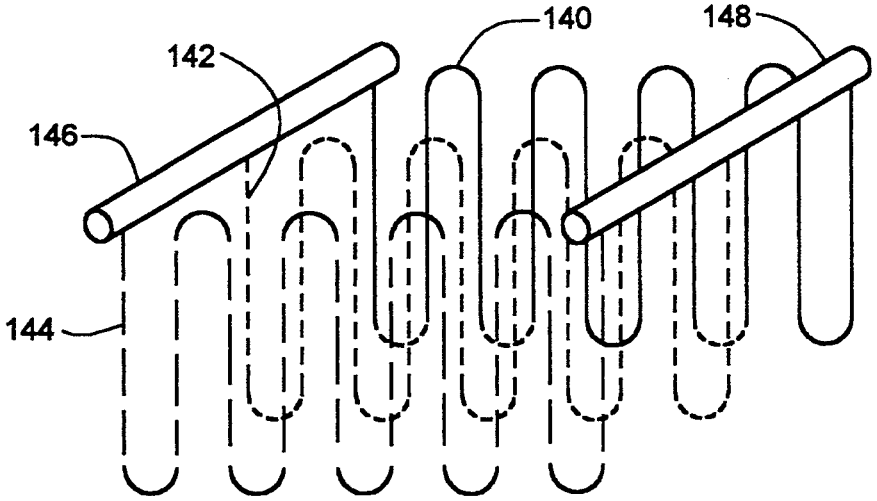
FIG. 8 is a schematic of another embodiment of a multiple tube form of the embodiment of FIG. 4.

Alternatively, and as illustrated in FIG. 8, three tubes, 140, 142 and 144, all of a serpentine configuration, may extend between headers 146 and 148. In this embodiment, the tubes 140, 142 and 144 are in respective ones of three parallel planes. The fins such as the fins 102, where corresponding runs of each of the tubes 140, 142 and 144 are aligned, extend from front to back of the heat exchanger illustrated in FIG. 8 or may be individual to each of the tubes 140, 142 and 144 as desired.

From the foregoing, it will be appreciated that a heat exchanger made according to the invention obtains the efficiencies in heat transfer associated with the use of relatively small hydraulic diameters and is ideally suited for providing an extremely compact heat exchanger of relatively small refrigerant capacity.

We claim:

1. A heat exchanger for exchanging heat between the ambient and a refrigerant that may be in a liquid or vapor phase, comprising:

a pair of spaced headers;

one of said headers having a refrigerant inlet;

one of said headers having a refrigerant outlet;

a heat exchanger tube extending between said headers and in fluid communication with each of said headers;

said tube defining a plurality of hydraulically parallel refrigerant flow paths between said headers;

each of said refrigerant flow paths having a hydraulic diameter up to about 0.07 inches;

hydraulic diameter being defined as the cross-sectional areas of a flow path multiplied by four (4) and divided by the wetted perimeter of the corresponding flow path.

2. The heat exchanger of claim 1 wherein said outlet is a condensate outlet and said heat exchanger is a condenser.

3. The heat exchanger of claim 1 wherein said outlet is a vapor outlet and said heat exchanger is an evaporator.

4. The heat exchanger of claim 1 wherein said tube is in a serpentine configuration.

5. The heat exchanger of claim 4 wherein said inlet and said outlet are in different ones of said headers.

6. The heat exchanger of claim 1 wherein said tube is a single tube in serpentine configuration.

7. The heat exchanger of claim 1 wherein there are a plurality of said tubes extending between said headers.

8. The heat exchanger of claim 7 wherein at least one of said tubes is in a serpentine configuration.

9. The heat exchanger of claim 8 wherein all of said tubes are in a serpentine configuration.

10. A heat exchanger for exchanging heat between the ambient and a refrigerant that may be in a liquid or vapor phase, comprising:

first and second spaced headers;

an inlet in one of said headers;

an outlet in the other of said headers;

means including at least one tube means in fluid communication with said headers and defining a plurality of hydraulically parallel refrigerant flow paths extending between said headers in a plurality of generally parallel runs, said refrigerant flow paths having a relatively small hydraulic diameter up to about 0.07 inches where hydraulic diameter is four (4) times the cross-sectional area of the flow path divided by the wetted perimeter of the flow path; and serpentine fins extending between and bonded to adjacent ones of said runs.

11. The heat exchanger of claim 10 wherein said plurality of generally parallel runs are defined by a tube bent in a serpentine configuration.

12. The heat exchanger of claim 10 wherein said flow paths include micro-cracks.

13. The heat exchanger of claim 10 wherein said flow paths include a crevice.

14. A heat exchanger for exchanging heat between the ambient and a refrigerant in a cooling system comprising:

a pair of spaced, generally parallel, elongated headers including a refrigerant inlet and a refrigerant outlet;

said headers each having a series of openings with the openings in the series on one header being aligned with and facing the openings in the series on the other header;

a tube row defined by a plurality of straight tubes of generally flat cross section and having opposed ends and extending in parallel between said headers, the ends of said tubes being disposed in corresponding aligned ones of said openings and in fluid communication with the interiors of said headers, at least some of said tubes being in hydraulic parallel to each other;

web means within said tubes and extending between and joined to opposed side walls of the tubes at spaced intervals to (a) define a plurality of non-circular flow paths within each tube, with said flow paths having at least one crevice, (b) absorb forces resulting from internal pressure within said heat exchanger and tending to expand said tubes, and (c) conduct heat between fluid in said flow paths and both said opposed side walls of said tubes, said flow paths being of relatively small hydraulic diameter of up to about 0.07 inches and defined as the cross-sectional area of the corresponding flow path multiplied by four (4) and divided by the wetted perimeter of the corresponding flow path; and serpentine fins incapable of supporting said tubes against substantial internal pressure extending between facing ones of said opposed side walls of adjacent tubes.

15. The heat exchanger of claim 14 wherein said web means is defined by an undulating insert bonded to said opposed side walls.

16. A heat exchanger for exchanging heat between the ambient and a refrigerant comprising:

a pair of headers;

one of said headers having a refrigerant inlet;

one of said headers having a refrigerant outlet;

said headers each having a series of elongated slots, the slots on one header facing the slots of the other;

a plurality of straight, flattened tubes having opposed ends extending in parallel between said headers, the ends of said flattened tubes being disposed in corresponding ones of said slots and in fluid communication with each of said headers;

an undulating insert in each of said flattened tubes defining a plurality of flow paths within each flattened tube between headers, said insert having crests on opposite sides thereof, said crests being bonded along substantially their entire length to the corresponding tube to provide said flow paths and to absorb forces resulting from internal pressure within the tubes and tending to expand the tubes;

each of said fluid flow paths having a hydraulic diameter in the range of up to 0.07 inches where hydraulic diameter is defined as the cross-sectional area of the corresponding flow path multiplied by four (4) and divided by the wetted perimeter of the corresponding flow path; and serpentine fins extending between the exterior of adjacent ones of said flattened tubes.

* * * * *

US005372188C1

(12) EX PARTE REEXAMINATION CERTIFICATE (5563rd)

United States Patent
Dudley et al.

(10) Number: US 5,372,188 C1
(45) Certificate Issued: Oct. 17, 2006

(54) HEAT EXCHANGER FOR A REFRIGERANT SYSTEM

(75) Inventors: Jack C. Dudley, Racine, WI (US); Leon A Guntly, Racine, WI (US)

(73) Assignee: Modine Manufacturing Company, Racine, WI (US)

Reexamination Request:
No. 90/003,911, Aug. 9, 1995

Reexamination Certificate for:

| | |
|---|---|
| Patent No.: | **5,372,188** |
| Issued: | **Dec. 13, 1994** |
| Appl. No.: | **07/998,043** |
| Filed: | **Dec. 29, 1992** |

Related U.S. Application Data

(63) Continuation-in-part of application No. 07/620,729, filed on Dec. 3, 1990, which is a division of application No. 07/141,628, filed on Jan. 7, 1999, now Pat. No. 4,998,580, which is a continuation-in-part of application No. 06/902,697, filed on Sep. 5, 1986, now abandoned, which is a continuation-in-part of application No. 06/783,087, filed on Oct. 2, 1985, now abandoned.

(51) Int. Cl.

| | |
|---|---|
| ***F28F 1/40*** | (2006.01) |
| ***F28F 1/42*** | (2006.01) |
| ***F25B 39/00*** | (2006.01) |

(52) U.S. Cl. ..... 165/110; 165/152; 165/153; 165/179; 165/183; 29/890.07; 29/890.049; 62/507; 62/515

(58) Field of Classification Search ..... 165/110, 165/152, 153, 179, 183, 111, 173, 174, 185, 165/176, 166, 149, 175; 29/890.049, 890.07, 29/890.035; 62/507, 515, 52
See application file for complete search history.

(56) References Cited

U.S. PATENT DOCUMENTS

| | | | | | |
|---|---|---|---|---|---|
| 2,099,186 | A | * | 11/1937 | Anderegg | |
| 2,158,383 | A | * | 5/1939 | Saunders et al. | |
| 2,278,086 | A | * | 3/1942 | Lea | 165/133 |
| 2,298,895 | A | * | 10/1942 | McKibben et al. | 165/176 |
| 2,410,180 | A | * | 10/1946 | Perkins | |
| 2,488,615 | A | * | 11/1949 | Arnold | |
| 2,899,177 | A | * | 8/1959 | Harris et al. | |
| 2,912,749 | A | * | 11/1959 | Bauernfeind et al. | |
| 2,959,401 | A | * | 11/1960 | Burton | |
| 2,985,433 | A | * | 5/1961 | Simpelaar | |
| 3,113,615 | A | * | 12/1963 | Huggins | 165/149 |
| 3,191,418 | A | * | 6/1965 | Modine | 165/185 |

(Continued)

FOREIGN PATENT DOCUMENTS

| | | | | |
|---|---|---|---|---|
| DE | 2705178 | * | 9/1977 | 165/150 |
| EP | 0219974 | * | 4/1987 | |
| EP | 0237164 | * | 9/1987 | |

(Continued)

OTHER PUBLICATIONS

Brazing Aluminum Automotive Heat Exchanger Assemblies Using a Non–Corrosive Flux Process, A. Sugihara, Nippon Light Metals, Copyright 1983 Society of Automotive Engineers, Inc.*

European Patent Office Patent Application Publication No. 0219974 to Guntly, published on Apr. 29, 1987 (corresponding to U.S. Appl. No. 06/902,697, filed Sep. 5, 1986 and abandoned on Sep. 7, 1986).

(Continued)

*Primary Examiner*—John K. Ford

(57) ABSTRACT

An improved heat exchanger for exchanging heat between the ambient and a refrigerant that may be in a liquid or vapor phase. The same includes a pair of spaced headers with one of the headers having a refrigerant inlet and the other of the headers having a refrigerant outlet. A heat exchanger tube extends between the headers and is in fluid communication with each of the headers. The tube defines a plurality of hydraulically parallel refrigerant flow paths between the headers and each of the refrigerant flow paths has a hydraulic diameter in the range of about 0.015 to about 0.07 inches.

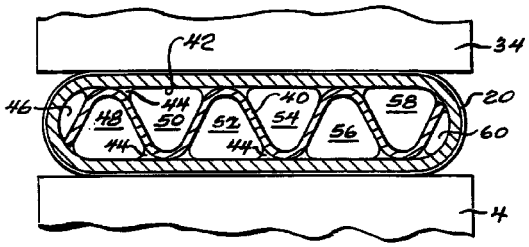

U.S. PATENT DOCUMENTS

| | | | | | |
|---|---|---|---|---|---|
| 3,231,017 | A | * | 1/1966 | Henderson | |
| 3,416,600 | A | * | 12/1968 | Fink | 165/175 |
| 3,457,990 | A | * | 7/1969 | Theophilos et al. | 165/133 |
| 3,574,917 | A | * | 4/1971 | Miyazaki | 29/202 |
| 3,689,972 | A | * | 9/1972 | Mosier et al. | 165/175 |
| 3,847,211 | A | * | 11/1974 | Fischel et al. | 165/166 |
| 3,951,328 | A | * | 4/1976 | Wallace et al. | 148/26 |
| 3,976,128 | A | * | 8/1976 | Patel et al. | 165/174 |
| 4,182,411 | A | * | 1/1980 | Sumitomo et al. | 165/110 |
| 4,202,405 | A | * | 5/1980 | Berg | 165/110 |
| 4,274,481 | A | * | 6/1981 | Ireland et al. | 165/166 |
| 4,314,605 | A | * | 2/1982 | Sumitomo et al. | 165/110 |
| 4,351,162 | A | * | 9/1982 | Yee | 62/239 |
| 4,380,907 | A | * | 4/1983 | Barnes et al. | 62/52 |
| 4,401,155 | A | * | 8/1983 | Royal et al. | 165/166 |
| 4,475,586 | A | * | 10/1984 | Grieb et al. | 165/176 |
| 4,492,268 | A | * | 1/1985 | Uehara et al. | 165/166 |
| 4,501,321 | A | * | 2/1985 | Real et al. | 165/153 |
| 4,524,823 | A | * | 6/1985 | Hummel et al. | 165/174 |
| 4,579,605 | A | * | 4/1986 | Kawase et al. | 148/26 |
| 4,615,385 | A | * | 10/1986 | Saperstein et al. | 165/175 |
| 4,688,311 | A | * | 8/1987 | Saperstein et al. | 29/157.3 R |
| 4,708,120 | A | * | 11/1987 | Mann | 123/563 |
| 4,736,727 | A | * | 4/1988 | Williams | 165/51 |
| 4,825,941 | A | * | 5/1989 | Hoshino et al. | 165/110 |
| 4,871,522 | A | * | 10/1989 | Doyle | 423/239 |
| 4,877,083 | A | * | 10/1989 | Saperstein | 165/176 |
| 4,936,381 | A | * | 6/1990 | Alley | 165/176 |
| 4,998,580 | A | * | 3/1991 | Guntly et al. | 165/173 |
| 5,205,347 | A | * | 4/1993 | Hughes | 165/174 |
| 5,241,839 | A | * | 9/1993 | Hughes | 165/174 |
| 5,279,360 | A | * | 1/1994 | Hughes et al. | 165/111 |
| 5,327,959 | A | * | 7/1994 | Saperstein et al. | 165/173 |
| 5,372,188 | A | * | 12/1994 | Dudley et al. | 165/110 |
| 5,567,394 | A | * | 10/1996 | Chu et al. | 422/177 |

FOREIGN PATENT DOCUMENTS

| | | | | |
|---|---|---|---|---|
| GB | 2058324 | * | 4/1981 | |
| GB | 1601954 | * | 11/1981 | |
| GB | 2133525 | * | 7/1984 | |
| JP | 47-32852 | * | 8/1972 | 123/563 |
| JP | 49-114145 | * | 10/1974 | |
| JP | 0073392 | * | 5/1982 | 165/150 |
| JP | 58-221390 | * | 12/1983 | 165/179 |
| JP | 59-13877 | * | 1/1984 | |
| JP | 59-52196 | * | 3/1984 | |

OTHER PUBLICATIONS

European Patent Office Patent Application Publication No. 0237164 to Saperstein et al., published on Sep. 16, 1987 (corresponding to U.S. Patent No. 4,688,311, issued on Aug. 25, 1987 to Saperstein et al.).

United Kingdom Patent Application Publication No. 2,058, 324 to Uehara et al. (misprinted as Ueda), published on Apr. 8, 1981 (corresponding to U.S. Patent No. 4,492,268 issued on Jan. 8, 1985 to Uehara et al.).

Japanese Laid Open Patent Application Publication No. 58–221390 to Ohara et al., published on Dec. 23, 1993, and translation.

Japanese Laid Open Utility Model Application Publication No. 59–13877 to Ohara et al., published on Jan. 27, 1984, and translation.

United Kingdom Patent Application Publication No. 2,133, 525 to Ohara et al., published on Jul. 25, 1984 (corresponding to Japanese Laid Open Patent Application Publication No. 58–129392, published on Jul. 25, 1984).

United States Patent No. 4,998,580 issued on Mar. 12, 1991 to Guntly et al. and related prosecution file histories of U.S. Appl. Nos. 06/702,087, 06/902,697 and 07/141,628 for Modine Admission that the plate fin condenser it sold to Caterpillar Tractor Company in 1983 was ancipitory prior art for condensers with flow paths having hydraulic diameters greater than 0.040 inch.

International Trade Commission Opinion In Invetigation No. 337–TA–334, In the Matter of Certain Condensers, Parts Thereof and Products Containing Same, Including Air Conditioners For Automobiles and select pages of Initial Determination either affirmed by the full ITC or helping explain the Commission Opinion.

* cited by examiner

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–16 are cancelled.

* * * * *